US006790284B2

(12) United States Patent
Suzuki

(10) Patent No.: US 6,790,284 B2
(45) Date of Patent: Sep. 14, 2004

(54) COATED FILM FORMING METHOD AND APPARATUS THEREFOR

(75) Inventor: Yasuji Suzuki, Tokyo (JP)

(73) Assignee: Illinois Tool Works Inc., Glenview, IL (US)

( * ) Notice: Subject to any disclaimer, the term of this patent is extended or adjusted under 35 U.S.C. 154(b) by 352 days.

(21) Appl. No.: 10/050,152

(22) Filed: Jan. 18, 2002

(65) Prior Publication Data

US 2002/0098282 A1 Jul. 25, 2002

(30) Foreign Application Priority Data

Jan. 19, 2001 (JP) ..... 2001-011077

(51) Int. Cl.[7] ..... B05C 11/10

(52) U.S. Cl. ..... 118/693; 118/694; 118/699; 118/702; 118/703; 118/318; 118/306; 118/DIG. 10; 156/356; 156/366; 156/578

(58) Field of Search ..... 118/699, 702, 118/703, 694, 693, 712, 306, 317, 318, DIG. 10, DIG. 11; 156/356, 366, 578

(56) References Cited

U.S. PATENT DOCUMENTS 3,658,033 A * 4/1972 Fuminier ..... 118/318
3,974,306 A * 8/1976 Inamura et al. ..... 427/183
4,137,928 A * 2/1979 Sentell ..... 134/167 C
4,976,797 A * 12/1990 Calvert et al. ..... 156/69

FOREIGN PATENT DOCUMENTS

JP 04-36363 * 12/1992 ..... 118/317

OTHER PUBLICATIONS

Patent Abstracts Of Japan Publication No. 09–085756, Mar. 31, 1997.
Patent Abstracts Of Japan Publication No. 05–329438, Dec. 14, 1993.

* cited by examiner

*Primary Examiner*—Richard Crispino
*Assistant Examiner*—George R. Koch, III
(74) *Attorney, Agent, or Firm*—Lowe Hauptman Gilman & Berner, LLP

(57) ABSTRACT

A coated film forming method is capable of readily forming a coated film of a thermoplastic material on a coated region of an inner peripheral surface of a cylinder. A nozzle, through which a molten paste of a thermoplastic material kept molten is discharged, is disposed toward an inner peripheral surface of a cylinder. The nozzle is moved along a rotational central line of the cylinder while rotating the cylinder and discharging the molten paste from the nozzle. Centrifugal force acting on the cylinder being rotated leads to spreading of the molten paste applied to the inner peripheral surface of the cylinder. Viscosity of the molten paste, a rotational speed of the cylinder and a speed of movement of the nozzle are set so as to keep the molten paste discharged from the nozzle from being scattered to a region other than the coated region.

4 Claims, 5 Drawing Sheets

COATED FILM FORMING METHOD AND APPARATUS THEREFOR

BACKGROUND OF THE INVENTION

This invention relates to a method for forming a coated film and an apparatus therefor, and more particularly to a method for forming a coated film on a desired region of an inner peripheral surface of a cylinder and an apparatus therefor.

In the prior art, an adhesive applying apparatus typically includes a cylindrical container (cylinder) which receives an adhesive curing upon contact with air, a nozzle arranged at a distal end of the container and a piston member arranged in an opening formed at a rear portion of the container, wherein the piston is driven toward the nozzle to discharge the adhesive from a distal end of the nozzle. In the conventional adhesive applying apparatus thus constructed, in order to prevent air from intruding from an outside of the apparatus through a gap between the piston and the adhesive thereinto immediately before starting of adhesive applying operation of the apparatus, an inner peripheral surface of the container is coated on a portion thereof at which the piston is initially arranged with a seal material so as to extend over a whole circumference thereof. In the prior art, such application of the seal material (thermoplastic material) to at least a part of the inner peripheral surface of the cylinder in a manner to extend over a whole circumference thereof is carried out by inserting a nozzle into an inner space of the cylinder to spray the seal material onto the portion of the inner peripheral surface. Also, such a conventional seal material applying apparatus uses a gear pump for generating a pressure required to feed the seal material in the form of a molten paste to the nozzle.

However, the above-described conventional techniques of forming an applied or coated film of the seal material by spraying cause the molten paste to be scattered to an undesired region of the inner peripheral surface of the cylinder other than a desired one thereof, leading to a failure to form the coated film on the desired region. In order to avoid the problem, techniques of carrying out spraying of the adhesive by means of a mask are proposed. Also, the paste applying apparatus using the gear pump is hard to control a pressure under which the thermoplastic material is discharged from the nozzle, to thereby fail to form the coated film into a uniform thickness.

SUMMARY OF THE INVENTION

The present invention has been made in view of the foregoing disadvantage of the prior art.

Accordingly, it is an object of the present invention to provide a coated film forming method which is capable of readily and uniformly coating or depositing a thermoplastic material on a desired region of an inner peripheral surface of a cylinder.

It is another object of the present invention to provide a coated film forming apparatus which is capable of permitting a thermoplastic material to be readily and uniformly coated on or applied to a desired region of a cylinder.

It is a further object of the present invention to provide a coated film forming apparatus which is capable of automatically replenishing a molten paste.

The present invention improves a method for forming a coated film of a thermoplastic material on a desired region of at least a part of an inner peripheral surface of a cylinder to be coated (hereinafter also referred to as "coated region") so as to extend in a whole circumferential direction thereof. The term "cylinder" as used herein is intended to cover a cylindrical structure having an opening provided on at least one end thereof. The method includes the steps of providing a paste applying machine for discharging a molten paste of the thermoplastic material kept molten by heating from a distal end of a nozzle, arranging the nozzle in a space in the cylinder so that the molten paste is discharged toward the inner peripheral surface of the cylinder, and moving the nozzle along a rotational center of the cylinder and within a range opposite to the region while rotating the cylinder in the circumferential direction and discharging the molten paste from the nozzle. Actually, the nozzle is inserted into the space in the cylinder through the opening thereof. In this instance, rotation of the cylinder in the circumferential direction may be carried out either in a right-hand direction (clockwise direction) or in a left-hand direction (counter-clockwise direction) as viewed from a side of the opening of the cylinder. Also, the nozzle for discharging the molten paste therefrom may be moved either from a position deep in the cylinder toward a side of the opening of the cylinder or from the side of the opening toward the deep position. Movement of the nozzle carried out while rotating it permits the molten paste to be applied in a spiral pattern to the inner peripheral surface of the cylinder. The method further includes the step of spreading the molten paste applied to the inner peripheral surface by means of centrifugal force acting on the cylinder being rotated, to thereby wholly cover the region with the molten paste.

A rotational speed of the cylinder is determined so as to permit adjacent lines of the molten paste spirally applied to be spread by centrifugal force, so that the lines may be joined together and a thickness of a coated film formed may be as uniform as possible. The rotational speed may be kept low during a period of time for which the molten paste is discharged. After the molten paste is discharged onto the coated region, the rotational speed may be increased so as to wholly cover the coated region with the molten paste. Alternatively, of course discharge of the molten paste from the nozzle may be carried out at a high speed from start of the discharge.

The thus-constructed method of the present invention permits the molten paste to be readily and positively applied to any desired coated region of the inner peripheral surface of the cylinder without use of any mask as required in the conventional spraying techniques.

In the present invention, viscosity of the molten paste, a rotational speed of the cylinder and a speed of movement of the nozzle are determined so as to prevent the molten paste discharged onto the inner peripheral surface from the nozzle from being scattered to a region other than the coated region.

The nozzle of the paste applying machine may have a discharge port which can be formed into any suitable shape, provided that it permits the molten paste to be linearly discharged. Typically, the discharge port of the nozzle may be formed into a substantially circle shape. In this instance, when the molten paste has viscosity set to be within a range of between 50 cp and 100 cp, the molten paste may be discharged from the nozzle under a pressure of 1 kg/cm2 or less under the conditions that a rotational speed of the cylinder is set to be within a range of between 2700 rpm and 3300 rpm, a speed of movement of the nozzle is set to be within a range of between 0.055 m/s and 0.08 m/s and a distance between the distal end of the nozzle and the inner peripheral surface of the cylinder is set to be within a range of between 3 mm and 7 mm. Such configuration positively keeps the molten paste discharged from the nozzle from being scattered to a region other than the coated region.

In addition, the present invention provides an apparatus for forming a coated film of a thermoplastic material on a region of at least a part of an inner peripheral surface of a cylinder so as to extend in a whole circumferential direction thereof. The apparatus includes a cylinder drive mechanism for rotating the cylinder in the circumferential direction about a central line of the cylinder, a paste applying machine for discharging a molten paste of the thermoplastic material kept molten by heating from a distal end of a nozzle, and a timing controller. The paste applying machine includes a gun head provided with the nozzle, a gun head moving mechanism for moving the gun head and a molten paste feed equipment for feeding the molten paste to the gun head. The timing controller is constructed in such a manner that operation timing of each of the cylinder drive mechanism, gun head moving mechanism, and molten paste feed equipment is determined so as to permit the cylinder to be rotated in the circumferential direction while keeping the nozzle arranged in a space in the cylinder and so as to permit the nozzle to be moved along a rotational center of the cylinder being rotated and within a range opposite to the region while keeping the molten paste discharged from the nozzle. Such construction permits a speed of movement of the gun head, a rotational speed of the cylinder and discharge of the molten paste to be readily optimized.

The molten paste feed equipment includes a molten paste feed unit (a feed change-over module and a pressure pump unit) which includes a storage tank in which the molten paste is stored and feeds the molten paste to the gun head under a predetermined pressure so as to permit the molten paste to be discharged from the nozzle under the predetermined pressure, and a molten paste replenishing unit for automatically replenishing the molten paste to the storage tank of the molten paste feed unit when the amount of molten paste in the storage tank of the molten paste feed unit is reduced to a level lower than a predetermined level.

The molten paste feed unit is constructed so as to keep a pressure in the storage tank at a constant level, so that the pressure in the storage tank permits the molten paste to be fed to the gun head. The molten paste in the molten paste replenishing unit is fed to the storage tank under a pressure which is set to be higher than the pressure in the storage tank. The storage tank of the molten paste feed unit is provided therein with a level sensor for detecting a level of the molten paste therein. The storage tank has a molten paste replenishing port provided with a control on/off valve which is kept open during a period of time for which a control command is inputted thereto and kept closed during the remaining period of time. The control on/off valve of the molten paste feed unit outputs the control command during a period of time defined between after the level sensor detects that a level of the molten paste in the storage tank of the molten paste feed unit is at a first level or below and before it detects that the level of the molten paste in the storage tank reaches a second level higher than the first level.

Such construction ensures that the molten paste is automatically replenished from the molten paste replenishing unit to the storage tank when the amount of molten paste stored in the storage tank is reduced due to an increase in discharge of the molten paste from the nozzle.

The molten paste feed unit is provided with an on/off valve, which is opened or closed by a command from the timing controller, in the midst of a molten paste feed pipe which connects the storage tank and the gun head. Controlling this on/off valve permits feed of the molten paste to the gun head to be positively managed.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, the present invention will be described hereinafter with reference to the accompanying drawings.

Figure 1:
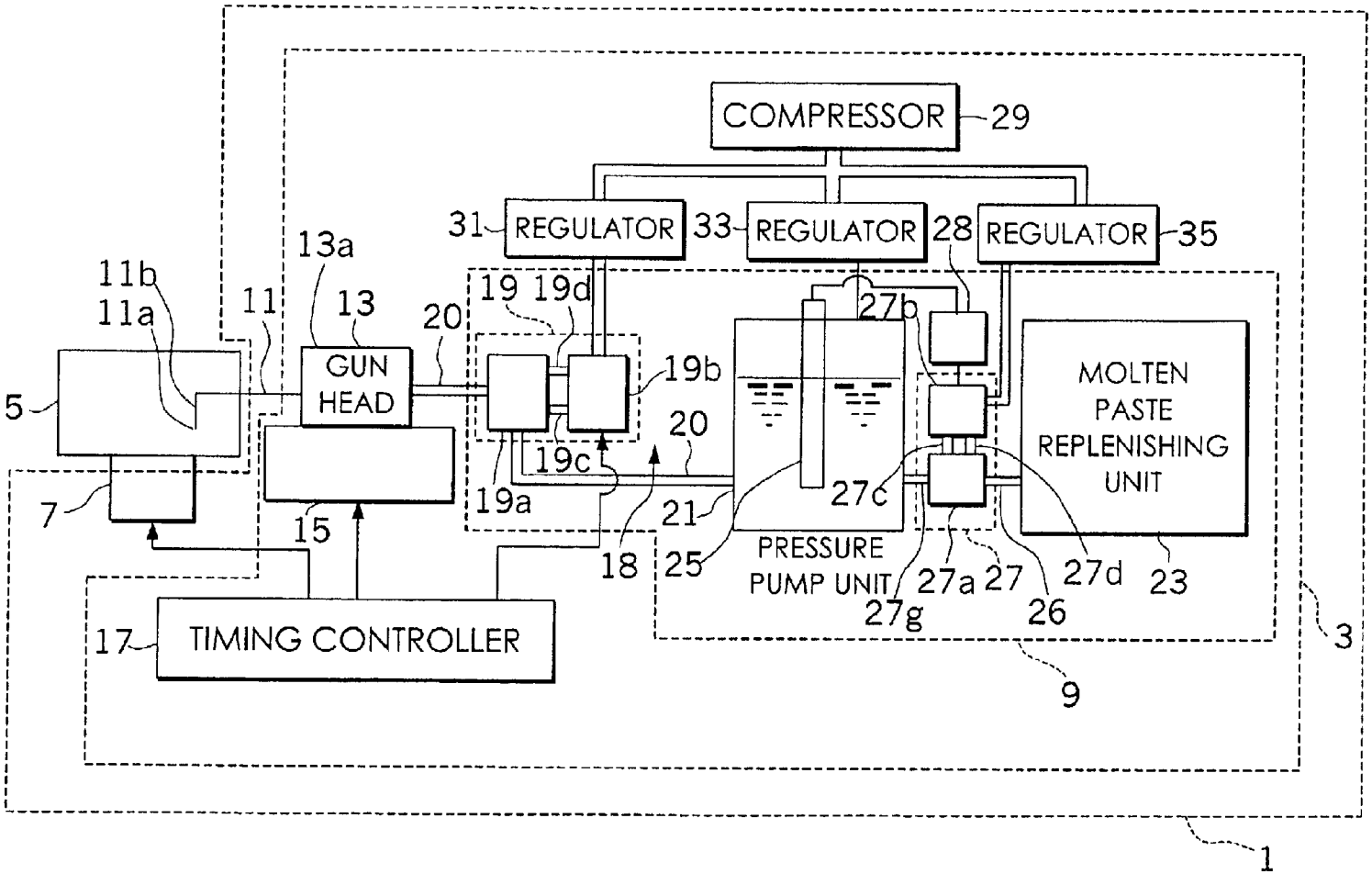
FIG. 1 is a diagrammatic view generally showing an embodiment of a coated film forming apparatus according to the present invention.

Referring first to FIG. 1, an embodiment of a coated film forming apparatus according to the present invention is illustrated. A coated film forming apparatus of the illustrated embodiment generally designated at reference numeral 1 generally includes a paste applying machine 3 for discharging a molten paste P and a cylinder drive mechanism 7 for rotating a cylinder 5 formed at at least one end thereof with an opening about a virtual central line CL (FIG. 3) thereof. The cylinder drive mechanism 7 may be constituted, for example, by two rollers juxtaposed to each other so as to render axes thereof parallel to each other, wherein at least one of the rollers is rotated through a roller drive source. The cylinder 5 is supported by the rollers while being arranged between the rollers so that the virtual central line CL thereof is substantially parallel to the axes of the rollers. Such arrangement of the cylinder 5, when at least one of the rollers is driven for rotation, permits the cylinder 5 to be rotated due to friction between the rollers and the cylinder 5. A rotational speed of the cylinder 5 is variably controlled by varying a rotational speed of the roller drive source.

Figure 4:
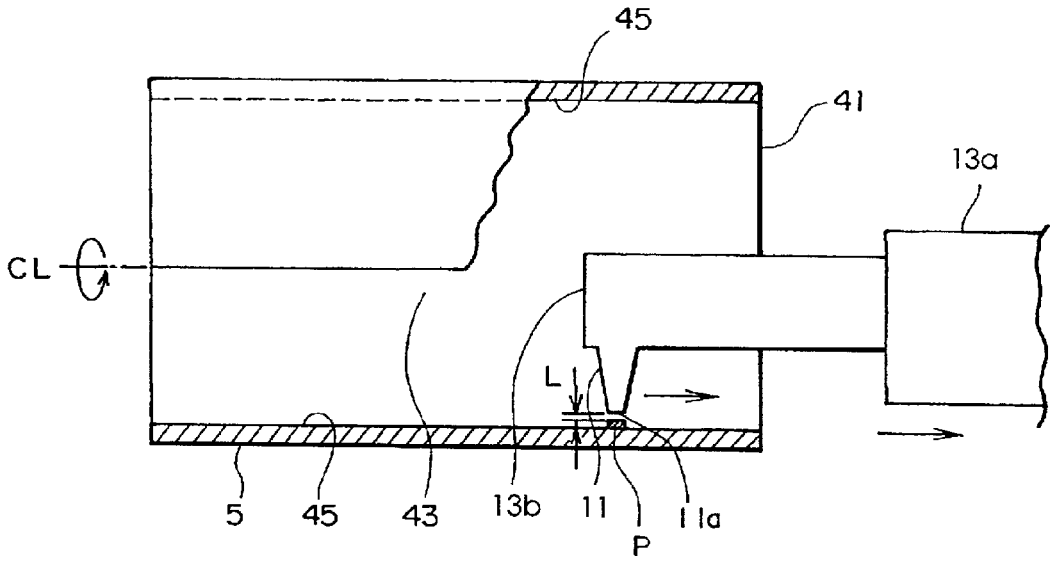
FIG. 4 is a partially broken sectional view showing application of a molten paste onto a cylinder.

The paste applying machine 3 includes a molten paste feed equipment 9, a gun head 13 equipped with a nozzle 11, a gun head moving mechanism 15 for linearly moving the gun head 13 along the virtual central line CL of the cylinder 5 in left-hand and right-hand directions in FIG. 1, and a timing controller 17. The gun head moving mechanism 15 may be constituted by a mechanism for linear movement known in the art such as a linear motor or the like. The gun head 13, as shown in FIG. 4, includes a body 13*a* arranged outside the cylinder 5 and supported on the gun head moving mechanism 15 and a straight pipe 13*b* arranged so as to horizontally extend from an end of the body 13*a* and acting to guide the molten paste P therein. The nozzle 11 is mounted on a distal end of the straight pipe 13*b* so as to extend in a direction perpendicular to that in which the straight pipe 13*b* extends and communicate with an internal passage of the straight pipe 13*b*. The nozzle 11 is configured in the form of a so-called circle nozzle having a discharge port 11*a* formed into a substantially circular shape. In the illustrated embodiment, the discharge port 11*a* of the nozzle 11 is formed into a diameter of 0.4 mm.

The paste applying machine 3 also includes a feed change-over module 19 arranged with respect to the gun head 13. The feed change-over module 19 includes an air-driven valve 19*a* operated while using air as a drive source therefor, as well as an air change-over valve 19*b* constituted by an electromagnetic valve or solenoid valve and acting to feed air for driving to the air-driven valve 19*a* through two lines. The air-driven valve 19*a* is kept closed while being fed with air from the air change-over valve 19*b* through a passage 19*c*. Also, the air-driven valve 19*a* is kept open while being fed with air through the passage 19*d* due to changing-over of the air change-over valve 19*b*. Operation of the feed change-over module 19 will be described hereinafter.

The molten paste feed equipment 9 includes a molten paste feed unit 18, feed change-over module 19, and pressure pump unit 21. The pressure pump unit 21 includes a storage tank 22 for storing the molten paste P therein. The storage tank 22 is connected to the gun head 13 through a molten paste feed pipe 20 provided at an intermediate portion thereof with the air driven valve 19*a*. The storage tank 22 includes a heating device for keeping the molten paste P molten and has an internal pressure set therein at a level sufficient to permit the molten paste P to be fed to the molten paste feed pipe 20.

Figure 2:
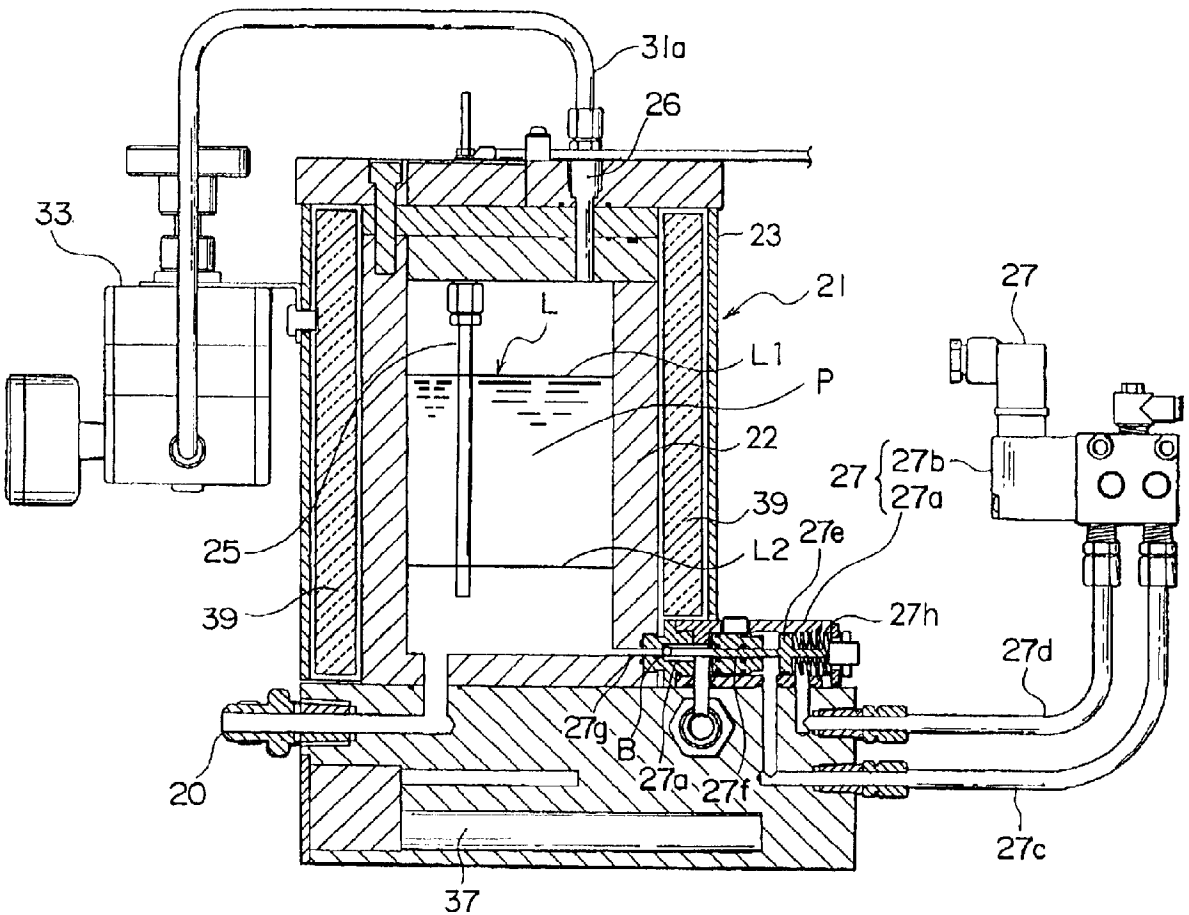
FIG. 2 is a partially sectional view showing a pressure pump unit incorporated in the coated film forming apparatus shown in FIG. 1.

The pressure pump unit 21 of the molten paste feed equipment 9, as shown in FIG. 2, is tightly closed with a lid member 24 of a casing 23 in which the storage tank 22 is received. The lid member 24 is provided thereon with a valve 26. The valve 26 is fed through an inflow pipe 31*a* with air which is delivered from a compressor 29 and of which a pressure is set at a predetermined level by a regulator 33. Also, the lid member 24 is mounted thereon with a level sensor 25 for measuring a level L of the molten paste P in the storage tank 22. In the illustrated embodiment, the level sensor 25 is constituted by a level sensor of the capacitance type.

The molten paste P stored in the storage tank 22 of the pressure pump unit 21 of the molten paste feed equipment 9 is heated by a heater 37 arranged under the storage tank 22, to thereby be kept molten. The storage tank 22 has a pressure at a predetermined level held therein by a pressure of air fed from the compressor 29 shown in FIG. 1. The storage tank 22 has a heat insulating material 39 arranged on an outer periphery thereof so as to surround the storage tank 22 therewith, resulting in preventing a temperature in the storage tank 22 from being rapidly reduced.

The storage tank 22 of the pressure pump unit 21 is connected through a control on/off valve 27 and a molten paste feed pipe 30 to a molten paste replenishing unit 23. The control on/off valve 27 functions to automatically replenish the molten paste P stored in the molten paste replenishing unit 23 therefrom to the storage tank 22 of the pressure pump unit 21. The control on/off valve 27 includes an air-driven valve 27*a* using air as a drive source therefor and an air change-over valve 27*b* constituted by an electromagnetic valve or solenoid valve operated for feeding air for driving to the air-driven valve 27*a*. The air change-over valve 27*b* operates depending on a control command fed thereto from a control unit 28. When air is fed through the air change-over valve 27*b* and a pipe 27*c* to the air-driven valve 27*a*, a piston rod 27*e* is moved in a direction away from the storage tank 22 to keep the air-driven valve 27*a* open. When air is fed from the air change-over valve 27*b* through a pipe 27*d*, the piston rod 27*e* is forced toward the storage tank 22 to keep the air-driven valve 27*a* closed. A rod member 27*f* of the piston rod 27*e* is mounted at a distal end thereof with a ball valve B, which functions to close a molten paste inlet of the storage tank 22. The air-driven valve 27*a*, when it is not fed with air, functions to urge the piston rod 27*e* toward the storage tank 22 by means of a spring 27*h*, resulting in being kept closed. In FIG. 2, the control on/off 27 is kept at a state which keeps the molten paste P from being replenished from the molten paste replenishing unit 23 to the storage tank 22. The control unit 28 outputs a change-over signal to the air change-over valve 27*b* depending on an output of the level sensor 25. When the level sensor 25 detects that the level L of the molten paste P in the storage tank 22 of the molten paste feed unit 21 is lower than a first level L1, the control unit 28 outputs, to the air change-over valve 27*b*, a change-over signal which permits air to be fed through the pipe 27*c*. This results in the air-driven valve 27*a* being open, so that the molten paste P may start to be automatically replenished from the molten paste replenishing unit 23 to the storage tank 22. Such replenishment of the molten paste P permits the level L of the molten paste P in the storage tank 22 to be raised. Then, when the level sensor 25 detects the level L of the molten paste reaches a second level L2 higher than the first level L1, the control unit 28 feeds the air change-over valve 27*b* with a change-over signal which permits air to be fed through the pipe 27*d*. This keeps the air-driven valve 27*a* closed, to thereby interrupt replenishment of the molten paste P from the molten paste replenishing unit 23 to the storage tank 22 of the molten paste feed unit 21. Such operation is repeated. The molten paste replenishing unit 23 is provided thereon with a heater (not shown), so that the molten paste P may be fed to the storage tank 22 while being kept constantly molten.

In FIG. 1, reference numeral 31 to 35 each designate a regulator, which functions to adjust a pressure of air fed from the compressor 29. The timing controller 17 outputs a rotation command to the cylinder drive mechanism 7 before feeding of a change-over command to the air change-over valve 19*b* or at the same time as the feeding. Also, the timing controller 17 concurrently outputs a movement command to the gun head moving mechanism 15. Upon receipt of the movement command from the timing controller 17, the gun head moving mechanism 15 moves the gun head 13 at a predetermined speed. When the gun head 13 is moved in a predetermined amount, the gun head moving mechanism 15 stops movement of the gun head 13. When the gun head 13 is stopped, the timing controller 17 feeds the air change-over valve 19*b* with a change-over command which permits the air-driven valve 19*a* to be closed. This results in the air-driven valve 19*a* being closed, to thereby keep the molten paste P in the storage tank 22 of the molten paste feed unit 21 from being fed to the gun head 13.

Figure 3:
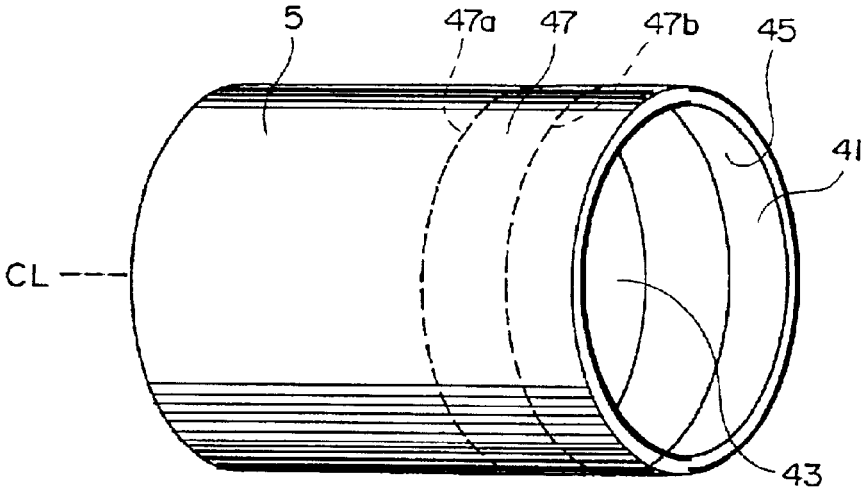
FIG. 3 is a perspective view showing a cylinder on which a coated film is formed by the coated film forming apparatus of FIG. 1.

Now, a manner in which the molten paste P is applied to the inner peripheral surface of the cylinder 5 by means of the thus-constructed coated film forming apparatus 1 of the illustrated embodiment will be described with reference to FIGS. 3 and 4.

The nozzle 11 is moved along the virtual central line CL of the cylinder 5 through an opening 41 of the cylinder 5 rotated by the cylinder drive mechanism 7 (not shown in FIGS. 3 and 4) toward an inner space 43 thereof. More specifically, the gun head 13 is moved by means of the gun head moving mechanism 15. When this results in the discharge port 11*a* of the nozzle 11 being moved to an end 47*a* of a coated region 47 of an inner peripheral surface 45 of the cylinder 5 on which the molten paste is to be coated, the cylinder 5 is rotated in the circumferential direction about the central line CL. In the illustrated embodiment, the end 47*a* of the coated region 47 is defined on a leftmost position in the cylinder 5 in FIG. 3. The cylinder may be rotated either in a right-hand direction or clockwise direction or in a left-hand direction or counter-clockwise direction. The cylinder 5 may have a rotational speed set to be within a range of, for example, between 2700 rpm and 3300 rpm. Also, a distance L between the discharge port 11*a* and the coated region 47 may be set to be within a range of between 3 mm and 7 mm.

Then, the nozzle 11 is moved to an end 47*b* of the coated region 47 of the inner peripheral surface 45 of the cylinder 5 positioned on a side of the opening 41 of the cylinder 5 while keeping the cylinder 5 at a rotational speed of 3300 rpm and discharging the molten paste P from the discharge port 11*a* of the nozzle 11. The molten paste P is discharged in an amount of 0.07 to 0.1 g from the discharge port 11*a* under a discharge pressure of 1 kg/cm2 or less while holding a speed of movement of the nozzle 11 at a level of between 0.055 m/s and 0.08 m/s.

The molten paste P discharged is coated on the coated region 47 while describing a spiral pattern thereon due to rotation of the cylinder 5 about the central line CL. Rotation of the cylinder 5 permits centrifugal force to act on the cylinder 5 and therefore the molten paste P spirally applied thereto, so that the spiral molten paste P may be spread while being increased in width thereof, resulting in a coated film of a uniform thickness being formed on the coated region 47.

Alternatively, a position at which the nozzle 11 is initially arranged for discharging the molten paste P therefrom (discharge start position) may be defined at the end 47*b* of the coated region 47 of the inner peripheral surface of the cylinder 5 on the side of the opening 41. In this instance, the nozzle 11 is moved to the end 47*a* of the coated region 47 of the inner peripheral surface 45 of the cylinder 5. Also, the illustrated embodiment may be constructed so that a rotational speed of the nozzle 11 is set to be lower than a predetermined rotational speed (for example, 3300 rpm) during a period of time for which the molten paste P is being coated on the coated region 47 and then increased to a level of the predetermined rotational speed after coating of the molten paste P on the coated region 47, so that the molten paste P may be spread on the coated region 47.

Such construction of the illustrated embodiment ensures formation of the coated film while preventing the molten paste P from being applied to a region of the inner peripheral surface of the cylinder 5 other than the coated region 47. Also, it permits the coated film to be formed into both a desired area and a uniform thickness.

Figure 5B:
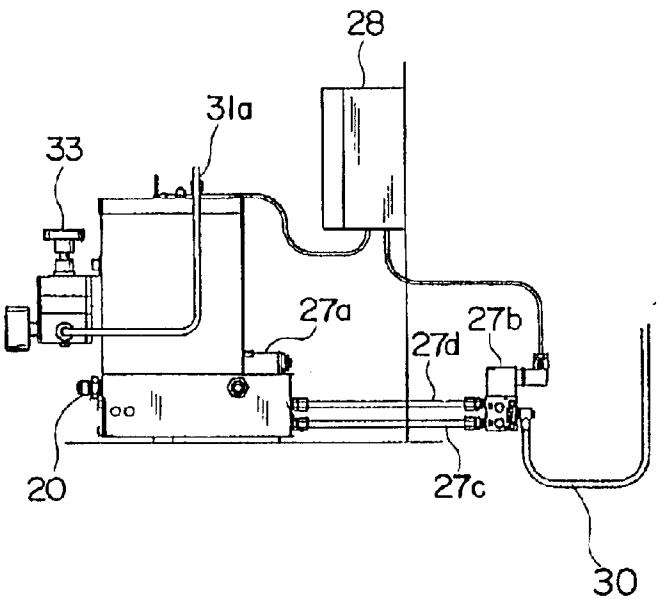
FIG. 5B is a side elevation view of the coated film forming apparatus shown in FIG. 5A.
Figure 5A:
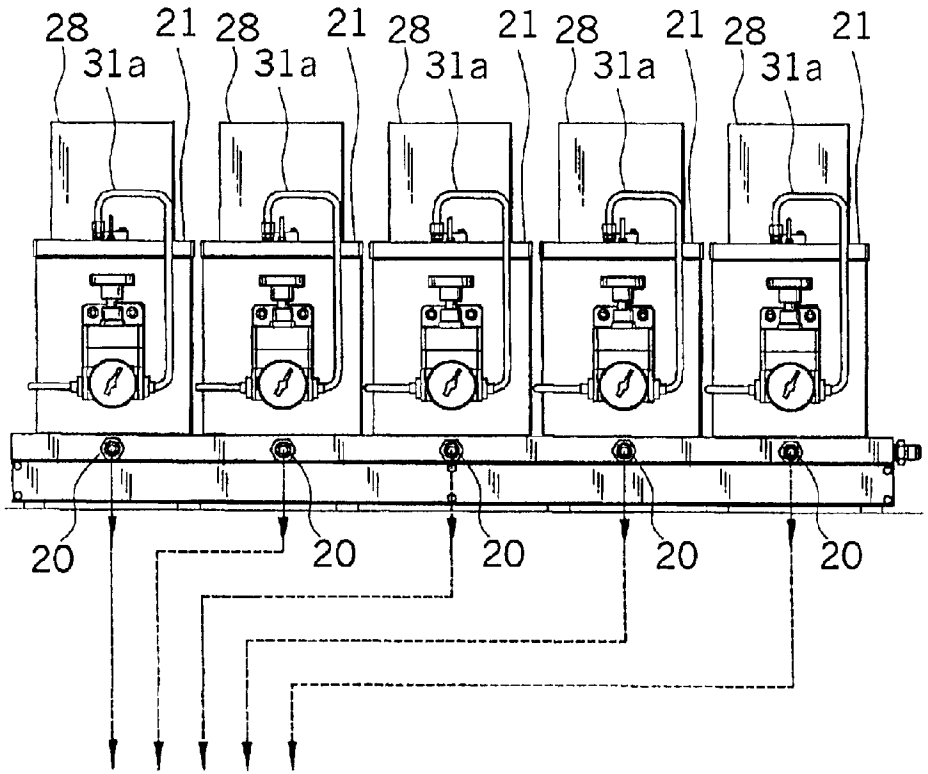
FIG. 5A is a plan view showing a plurality of coated film forming apparatus according to the present invention arranged in juxtaposition to each other.

The coated film forming apparatus of the illustrated embodiment may be applied to arrangement shown in FIG. 5, wherein a plurality of the coated film forming apparatus according to the present invention are connected to each other in parallel for coated film formation. Such arrangement permits the coated film to be concurrently formed on five cylinders.

As can be seen from the foregoing, the present invention constructed as described above permits the coated film to be reliably formed on a desired coated region of the inner peripheral surface of the cylinder without being applied to a region thereof other than the coated region, to thereby reduce proportion defectives.

Also, the coated film forming apparatus of the present invention permits the molten paste to be automatically replenished to the storage tank, to thereby eliminate troublesome operation of replenishing the molten paste. Also, it eliminates necessity of interrupting operation of the apparatus in order to replenish the molten paste, to thereby increase operating efficiency of the apparatus.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An apparatus for forming a coated film of a thermoplastic material on a region of at least a part of an inner peripheral surface of a cylinder so as to extend in a whole circumferential direction thereof, comprising:

a cylinder drive mechanism for rotating said cylinder in said circumferential direction about a central line of said cylinder;

a paste applying machine for discharging a molten paste of said thermoplastic material kept molten by heating from a distal end of a nozzle; and a timing controller;

said paste applying machine including a gun head provided with said nozzle, a gun head moving mechanism for moving said gun head and a molten paste feed equipment for feeding said molten paste to said gun head;

said timing controller being constructed in such a manner that operation timing of each of said cylinder drive mechanism, said gun head moving mechanism, and said molten paste feed equipment is determined so as to permit said cylinder to be rotated in said circumferential direction while keeping said nozzle arranged in a space in said cylinder and so as to permit said nozzle to be moved along a rotational center of said cylinder being rotated and within a range opposite to said region while keeping said molten paste discharged from said nozzle.

2. An apparatus as defined in claim 1, wherein said molten paste feed equipment includes:

a molten paste feed unit which includes a storage tank in which said molten paste is stored and feeds said molten paste to said gun head under a predetermined pressure so as to permit said molten paste to be discharged from said nozzle under said predetermined pressure; and a molten paste replenishing unit for automatically replenishing said molten paste to said storage tank when the amount of said molten paste in said storage tank of said molten paste feed unit is reduced to a level lower than a predetermined level.

3. An apparatus as defined in claim 2, wherein said molten paste feed unit is constructed so as to keep a pressure in said storage tank at a constant level, so that the pressure in said storage tank permits said molten paste to be fed to said gun head;

said molten paste in said molten paste replenishing unit is fed to said storage tank under a pressure which is set to be higher than said pressure in said storage tank;

said storage tank of said molten paste feed unit is provided therein with a level sensor for detecting a level of said molten paste therein; and said storage tank has a molten paste replenishing port provided with a control on/off valve which is kept open during a period of time for which a control command is inputted thereto and kept closed during the remaining period of time;

said control on/off valve of said molten paste feed unit outputting said control command during a period of time defined between after said level sensor detects that a level of said molten paste in said storage tank is at a first level or below and before it detects that the level of said molten paste in said storage tank reaches a second level higher than said first level.

4. An apparatus as defined in claim 2, wherein said molten paste feed unit is provided with an on/off valve, which is opened or closed by a command from said timing controller, in the midst of a molten paste feed pipe which connects said storage tank and said gun head.

* * * * *